United States Patent [19]

Krill et al.

[11] Patent Number: 4,459,126

[45] Date of Patent: Jul. 10, 1984

[54] CATALYTIC COMBUSTION PROCESS AND SYSTEM WITH WALL HEAT LOSS CONTROL

[75] Inventors: Wayne V. Krill, Sunnyvale; Edward K. Chu; John P. Kesselring, both of Mountain View, all of Calif.

[73] Assignee: United States of America as represented by the Administrator of the Environmental Protection Agency, Washington, D.C.

[21] Appl. No.: 381,743

[22] Filed: May 24, 1982

[51] Int. Cl.[3] ..... F23D 3/40

[52] U.S. Cl. ..... 431/7; 431/170; 422/199

[58] Field of Search ..... 431/7, 10, 170, 328; 422/171–174, 190, 194, 199

[56] References Cited

U.S. PATENT DOCUMENTS

| | | | |
|---|---|---|---|
| 3,421,859 | 1/1969 | Kruggel | 431/328 |
| 3,801,289 | 4/1974 | Wiley | 422/179 |
| 3,886,739 | 6/1975 | Lee | 422/199 |
| 4,154,568 | 5/1979 | Kendall et al. | 431/7 |
| 4,230,443 | 10/1980 | Berg et al. | 431/7 |
| 4,354,821 | 10/1982 | Kesselring et al. | 431/7 |
| 4,355,003 | 10/1982 | Grobel | 422/199 |

*Primary Examiner*—Carroll B. Dority, Jr.

[57] ABSTRACT

A process and system of operation for combusting nitrogen-containing fuels with resulting low $NO_x$ emissions. A fuel-rich mixture of the fuel is combusted in a catalytic bed which is carried by a support structure. Active or passive means are provided for limiting transfer of heat from the bed into the support structure for minimizing formation of $NO_x$ during combustion. The active means for limiting the heat transfer includes, in different embodiments, electrical resistance back heating, induction back heating, exhaust gas back heating, and combustion fired back heating. The passive means for limiting the heat transfer includes, in different embodiments, a body of heat insulating material between the bed and support structure, or the insulating effect of the outer cells of the bed within a recess in the support structure.

7 Claims, 11 Drawing Figures

CATALYTIC COMBUSTION PROCESS AND SYSTEM WITH WALL HEAT LOSS CONTROL

This invention described in this patent was made in the course of work under U.S. Environmental Protection Agency Contract No. 68-02-3122. The Government of the United States has certain rights in this invention.

This invention relates in general to the combustion of nitrogen-containing fuels in systems where low nitrogen oxide emissions are desirable, such as firetube and watertube boilers and gas turbines.

In combustion technology various system designs have been developed in an effort to lower the emissions of $NO_x$ from the conversion of nitrogen compounds contained in fuels. In catalytic combustion systems 10% to 65% conversions of fuel nitrogen to $NO_x$ have been achieved through staged combustion systems. Such a two-stage catalytic combustion system is disclosed in U.S. patent application Ser. No. 252,887 filed Apr. 10, 1981 by Wayne V. Krill, et al and now abandoned. The two-stage combustion system operates fuel-rich in the first stage and achieves partial combustion of the incoming fuel. Interstage heat exchange is used to control second stage temperatures under overall stoichiometric conditions, and secondary air is injected to complete hydrocarbon oxidation. For overall lean combustion systems, interstage heat exchange is not required.

From an environmental standpoint it is highly desirable that nitrogen oxide emissions from combustion systems be reduced to levels even lower than those attainable with existing techniques, such as the above-described two-stage catalytic combustion system. Ultra low conversions of fuel nitrogen to $NO_x$ are particularly desirable in combustion systems such as firetube and watertube boilers and gas turbines.

It is, accordingly, a principal object of the present invention to provide a new and improved process and system of apparatus for combusting nitrogen-containing fuels with resulting low $NO_x$ emissions.

Another object is to provide a process and system of the type described employing multiple stage combustion zones with wall heat loss from the catalyst bed controlled in the fuel-rich combustion zones to minimize formation of $NO_x$.

Another object is to provide a process and system of the type described employing a monolithic catalyst bed with wall heat loss from the bed controlled in a manner to minimize $NO_x$ formation from combustion within the bed.

The invention in summary comprises a process and system of apparatus in which the catalytic bed in at least one fuel-rich combustion zone is carried by a support structure with provision for limiting heat loss or transfer of thermal energy from the bed into the support structure. Control of the heat loss maintains the outer perimeter of the bed at an optimum temperature which minimizes $NO_x$ formation. The invention is employed with optimum effect in one or more fuel-rich stages of multiple stage combustors in which secondary air is added for completing combustion in a downstream zone. In different embodiments of the invention transfer of the thermal energy from the fuel-rich bed is limited by active or passive means. The active means include heating of the support structure about the bed by electrical-resistance or magnetic inductance heating, or by back-heating from the combustion exhaust, or by back-heating with a separate flame. The passive means include thermal insulation about the bed as by a layer of insulation material, or by insulation from the outer cells where the bed is a monolithic cellular configuration.

The foregoing and additional objects and features of the invention will appear from the following description in which the several embodiments have been set forth in conjunction with the accompanying drawings.

The process and system of apparatus of this invention incorporates the principle of operation in which a nitrogen-containing fuel is combusted in a bed of catalyst material with means for controlling heat transfer from the bed into the bed support structure or wall. A novel aspect of this principle of operation is that control of the wall heat loss affects the combustion operating temperature in the outer peripheral region of the bed which in turn affects the chemistry of $NO_x$ formation during combustion. The important result from the invention is that limitation of the heat transfer from the bed materially minimizes $NO_x$ formation. This effect of minimizing $NO_x$ formation is obtained over a wide range of stoichiometry in the combustion reactants. In a multiple stage combustor, the inventive concept is employed with markedly improved results through control of the heat loss from the catalytic beds of the fuel-rich combustion zones.

Figure 1:
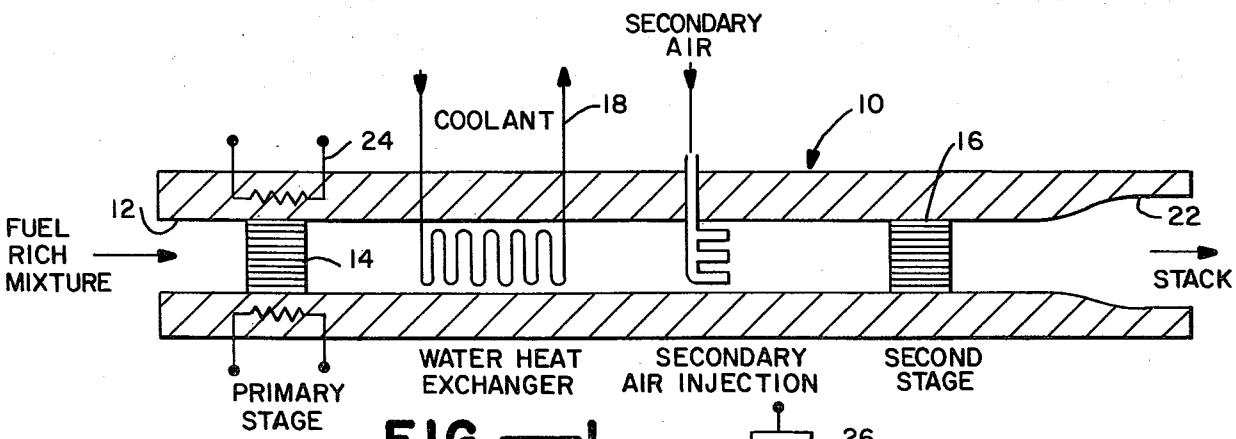
FIG. 1 is a schematic axial section view showing a two-stage catalytic combustion system incorporating one embodiment of the invention.

In the drawings FIG. 1 depicts in schematic form a two-stage catalytic combustor system 10 adapted to carry out the process of the invention. Combustor 10 comprises a channel wall 12 forming a flow path for the hydrocarbon fuel and air reactants. A bed 14 of catalyst material is supported by the channel wall at the primary stage location for fuel-rich combustion. A downstream bed 16 of catalyst material is supported by the wall at the secondary stage location. Preferably, the beds of the primary and secondary stages are of monolithic, cellular configuration. The beds of either or both of the primary and secondary stages can be of the type described in U.S. Pat. No. 4,154,568 issued May 15, 1979 to Kendall, et al., which incorporates bed cells of graduated size for achieving high combustion efficiency under stable combustion conditions. The beds of either or both of the primary and second stages can also be of the type described in U.S. Pat. No. 4,204,829 issued May 27, 1980 to Kendall et al. which provides for control of radiant energy absorption from catalytic cylinders in the combustion zone.

Interstage heat exchange means 18 is provided within the flow channel between the primary and secondary stages for absorbing heat from the primary stage exhaust and thereby control combustion temperature in the secondary stage under overall stoichiometric conditions so that the use temperature of the catalyst material is not exceeded. Preferably the interstage heat exchange means comprises a heat exchanger coil through which a suitable coolant, such as water, is circulated at a controlled rate. Air injector means 20 is positioned within the channel between the stages for injecting secondary air for mixing with the first stage exhaust. The secondary air is injected at a controlled rate to provide overall stoichiometric theoretical air for the two stages. This mixture is directed into the secondary stage for combustion to complete burn-out of the fuel. Exhaust from the second stage can be routed through outlet 22 directly to a stack, or directed in heat exchange relationship with a suitable heat exchanger coil, not shown, for recovery of waste heat. Where the process is carried out with overall lean combustion conditions then interstage heat exchanger is not required.

In the invention means is provided for controlling or limiting the transfer of thermal energy or heat loss from the bed of the primary zone into the bed's support structure or channel wall. Control of this heat loss from the outer cell region of the bed controls the operating temperature in this region which in turn affects the chemistry of $NO_x$ formation. Limiting the heat transfer from the bed into the surrounding support structure minimizes the conversion of fuel nitrogen to $NO_x$. This concept of the invention is most advantageously employed in the fuel-rich combustion zone of the primary stage 14 in a two-stage combustor as in FIG. 1, as well as in multiple-stage combustors having three or more combustion zones where a plurality of fuel-rich zones are employed.

Figure 2:
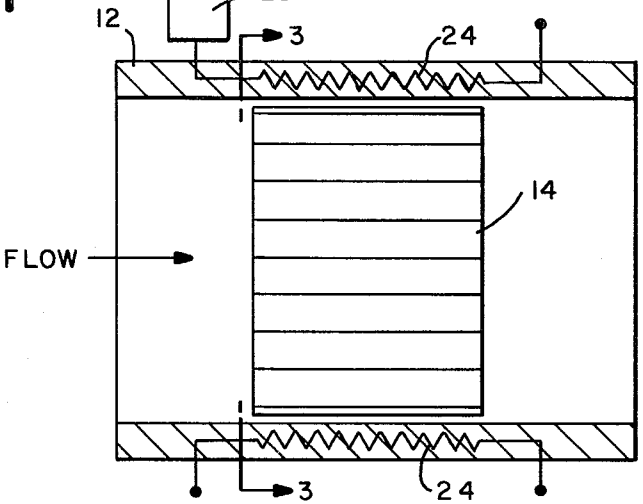
FIG. 2 is a side elevation view of the catalytic bed in the fuel-rich combustion zone of the system of FIG. 1.
Figure 3:
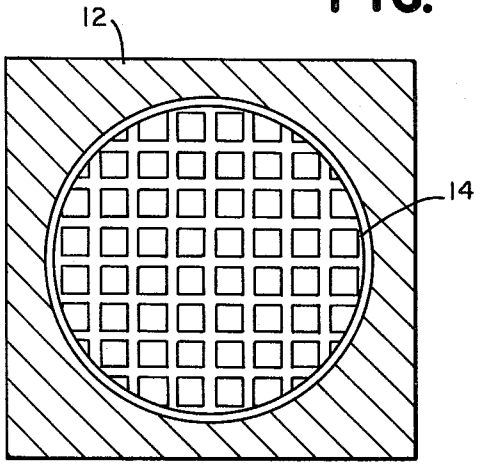
FIG. 3 is a cross-sectional view along the line 3—3 of FIG. 2 illustrating the structure for supporting the catalytic bed.

The means for limiting thermal energy transfer or heat loss from the fuel-rich zone can be by either an active or passive mechanism. In the embodiment of FIGS. 1–3 an active mechanism is employed comprising electrical resistance or guard heater elements 24 carried or embedded in the support structure or channel wall about the primary stage bed. Suitable electrical circuit means 26 is provided to control resistance heating of the elements for back-heating of the wall to a predetermined temperature and thereby reduce the temperature gradient between the wall and bed perimeter to limit the heat loss from the bed.

Figure 4:
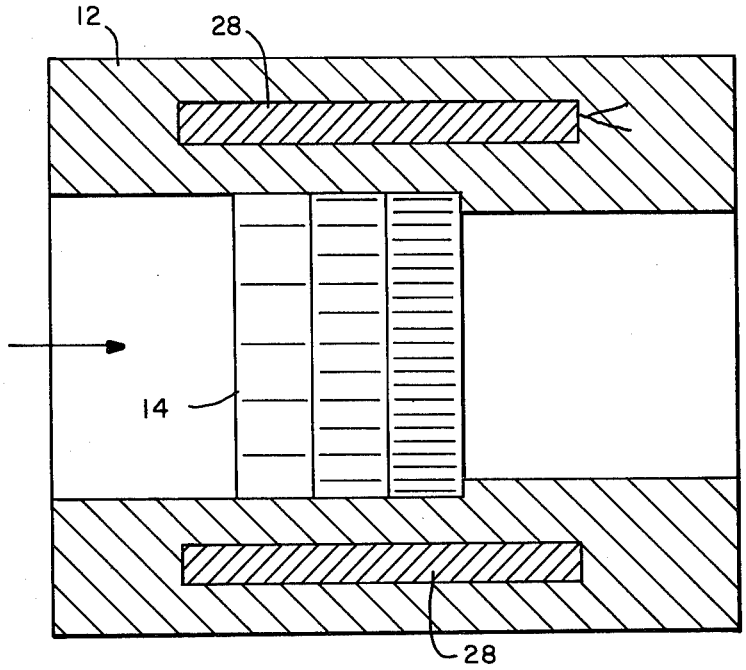
FIG. 4 is a schematic view of another embodiment incorporating inductance heating for limiting the transfer of thermal energy.

In another embodiment of the invention shown in FIG. 4 the back-heating of the channel wall 12 about bed 14 for limiting heat loss provides an active mechanism comprising electrical control means 28 for inductance heating of the wall. The control means 28 includes conventional inductor coils, not shown, through which current is cycled for generating a varying electro-magnetic field passing through the wall which is thereby heated by induction. For this purpose the wall or support can be comprised of a metal, e.g., stainless steel, for the induction heating effect.

Figure 5:
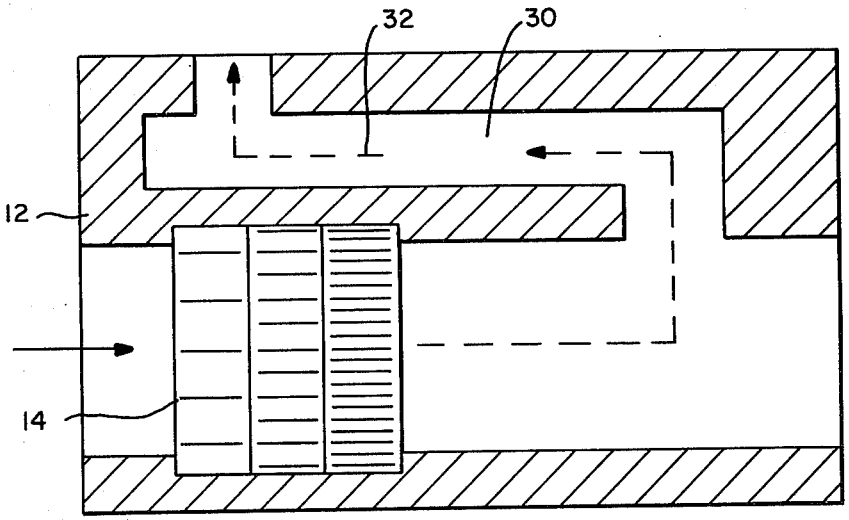
FIG. 5 is a schematic of an embodiment incorporating exhaust gas back-heating for limiting transfer of the thermal energy.

Another embodiment shown in FIG. 5 provides an active back-heating mechanism comprising means forming a recirculating channel 30 for directing a portion of the products of combustion from the primary zone along the path 32 in heat-exchange relationship with the portion of the channel wall 12 which provides the support structure for the first catalytic bed 14 of a combustor as in FIG. 1. Recirculating channel 30 can encircle all or part of the wall about the first bed, and flow control means, not shown, can be provided in the recirculating channel, as required for maintaining the back-heating temperature at the level desired for the required limitation on heat transfer from the bed.

Figure 6:
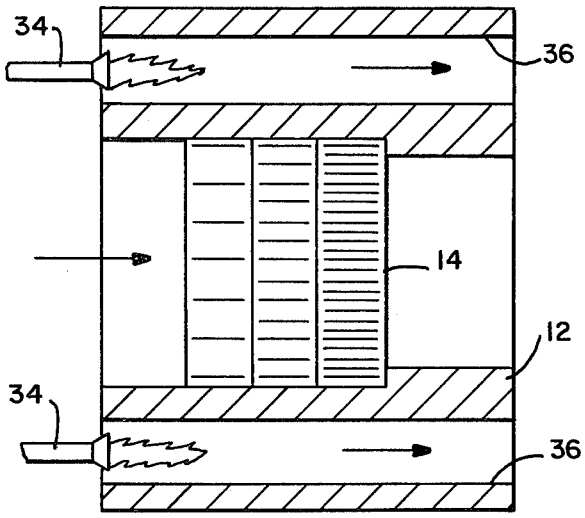
FIG. 6 is a schematic view of another embodiment incorporating a combustion flame system for limiting transfer of thermal energy.

Another embodiment shown in FIG. 6 provides an active back-heating mechanism comprising burner means 34 for directing high temperature flame against a portion of the wall 12 or structure supporting the primary stage bed 14 in a combustor as in FIG. 1.

The burner means can operate on a suitable fuel such as natural gas, propane, and the like to produce flames directed along channels 36 formed in the wall about the bed. Suitable burner control means, not shown, is provided for controlling the level of the back-heating temperature to provide the required limitation on heat loss from the bed.

Figure 7:
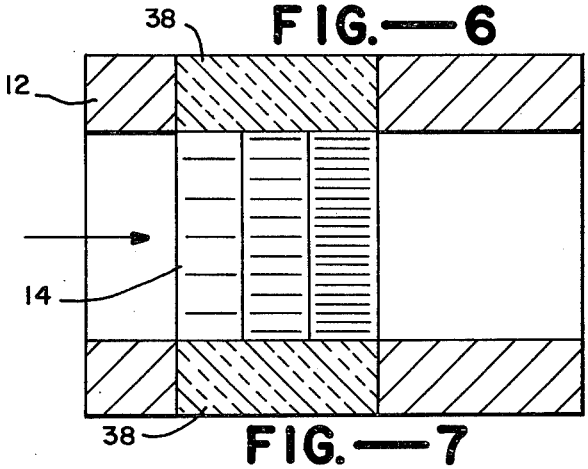
FIG. 7 is a schematic view of another embodiment incorporating a body of insulating material for limiting transfer of the thermal energy.

Another embodiment shown in FIG. 7 provides a passive back-heating mechanism comprising a body 38 of heat insulating material. The body of heat insulating material can itself form the wall or support structure for the bed 14 in the primary zone of a combustor as in FIG. 1. The insulating material can also be formed in one or more layers disposed between the support structure and the bed perimeter. The composition of the insulating material can be of the fibrous insulation type, or of the light weight castable type, or of the dense castable refractory type, depending upon the particular requirements and operating conditions.

Figure 8:
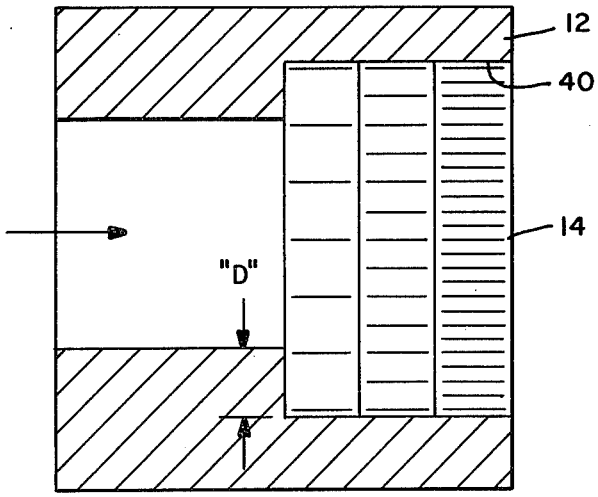
FIG. 8 is a schematic view of another embodiment in which the cells in the outer perimeter margin of the monolithic catalyst bed provide insulation to limit transfer of the thermal energy.

Another embodiment illustrated in FIG. 8 provides a passive back-heating mechanism in which the outer margin or region of cells of the monolith bed 14 provide a heat insulating barrier. In this embodiment, an annular recess 40 is formed in the wall 12 or support structure about the bed 14 of the first stage in a combustor as in FIG. 1. The outer perimeter margin of the bed is seated about its circumference within the recess. Preferably, the outer margin of the bed is seated within the recess to a depth "D" of at least two-cell diameters. The recess portion of the support structure blocks the flow of reactants through the outer margin of the cells to limit heat loss by insulating heat conduction radially from the bed as well as limiting downstream convection losses.

An example of the operation of the process and system of the invention is carried out employing a combustor according to the embodiment of FIGS. 1–3 utilizing electrical resistance back-heating in the support structure of a monolithic catalyst bed of honeycomb cell configuration. Nickel oxide is employed as the catalyst material in the bed. In the process of the example the fuel employed is natural gas with 0.62% nitrogen in the fuel (as $NH_3$). The operating conditions of the process and the resulting concentrations of emissions in the exhaust are set forth in Table I and Table II. The data indicated for Test Points 1 through 13 were obtained utilizing a catalytic bed of one-inch diameter and the data for the Test Points 14 through 18 were obtained utilizing a bed diameter of three inches. The back-heating guard temperature of the wall about the bed for this series of test points was 1253° K.

Figure 10:
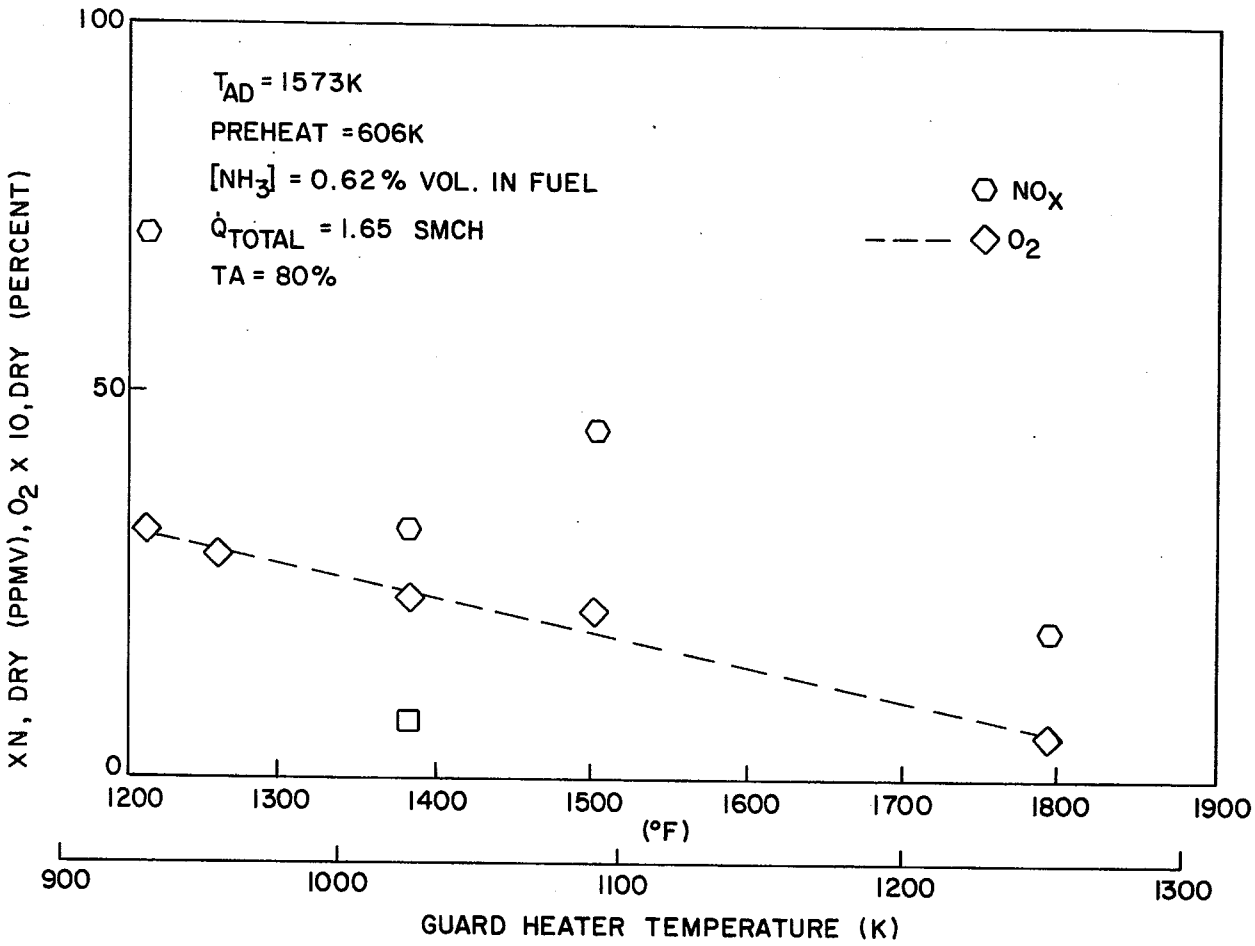
FIG. 10 is a graph illustrating the operating results from the process and system showing the effect of variation of heat loss from the bed.

During the operation of the example, the effect of wall heat loss on $NO_x$ production was measured by varying the guard heater temperature within the wall about the bed. The different back-heating temperatures are given at the bottom of Table I under the column headed "$T_{Guard}$." This data is represented graphically in FIG. 10, and the graph shows that the level of $NO_x$ decreases as a function of increasing guard heater temperature. FIG. 10 also shows that exhaust concentrations of $O_2$ increase with heat loss (lower guard heater temperatures), suggesting that the remaining oxygen results in oxidation of nitrogen species in the post-reactor region.

Figure 9:
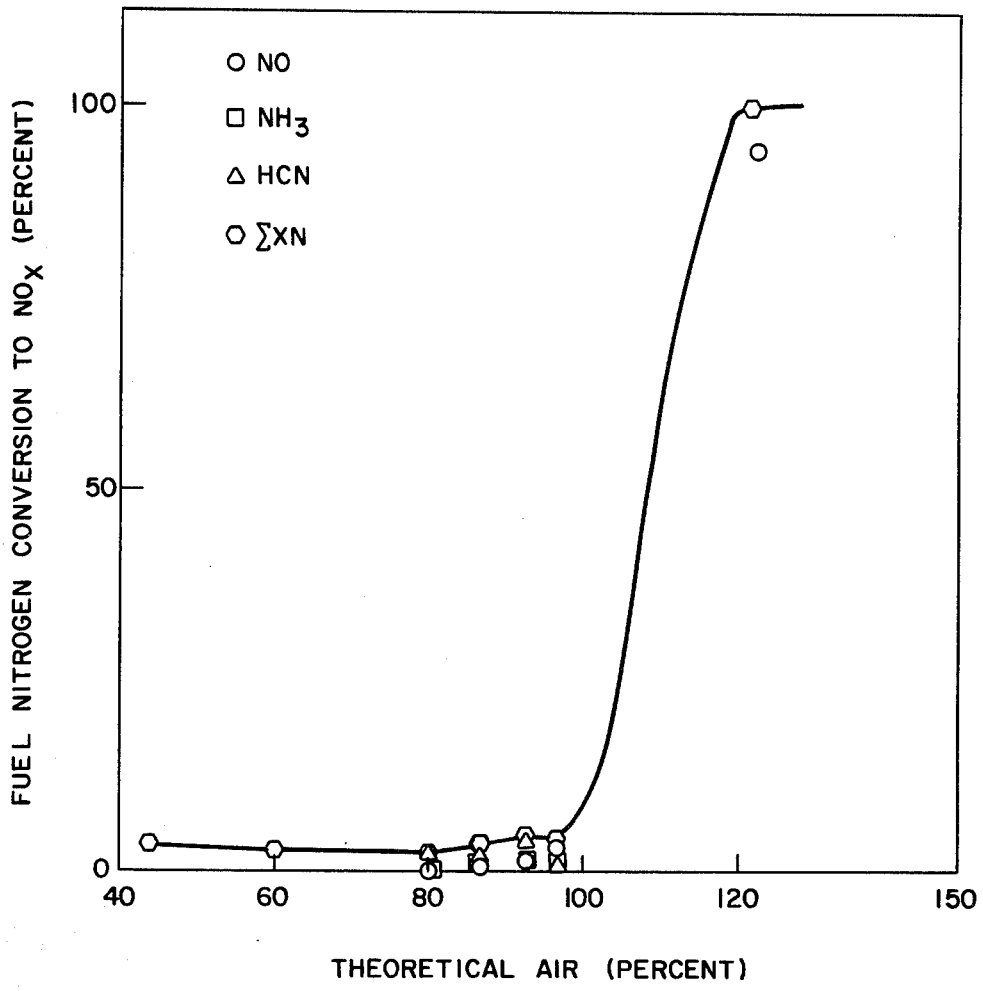
FIG. 9 is a graph illustrating the operating results of the process and system of the invention.

The graph of FIG. 9 plots the percent of fuel nitrogen conversion to $NO_x$ as a function of theoretical air from the data of Tables I and II. The plot shows that fuel nitrogen conversions of approximately 5% are achieved over a range of stoichiometries from 42% to 95% theoretical air. This demonstrates that the fuel-rich stage of the staged catalytic combustor can operate at any stoichiometry within this range, provided that adequate temperature control is designed into the system, and achieve very low $NO_x$ emissions from the combustion of nitrogen-containing fuels.

Figure 11:
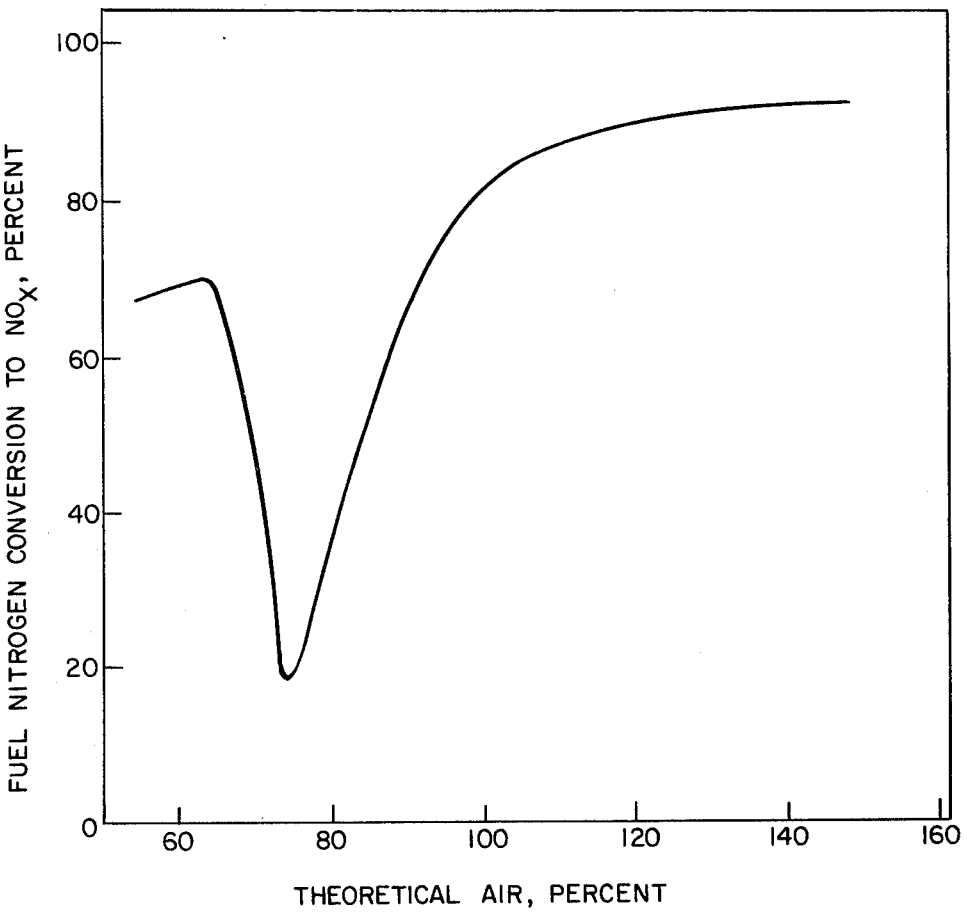
FIG. 11 is a graph illustrating fuel nitrogen conversation in a prior art catalytic combustion system with uncontrolled wall heat loss.

A comparison with the operating results from conventional combustion techniques, as depicted in the graph of FIG. 11, demonstrates the significantly improved results in fuel nitrogen conversion in the present invention. FIG. 11 is a plot of fuel nitrogen conversion to $NO_x$ as a function of theoretical air from combustion of natural gas with 0.62% nitrogen in a monolithic bed having a nickel oxide catalyst and in which there is no provision for controlling or limiting heat loss from the bed. The plot of FIG. 11 shows that the lowest fuel nitrogen conversion attainable is only 20% occurring at 75% theoretical air.

While the foregoing embodiments are at present considered to be preferred, it is understood that numerous variations and modifications may be made therein by those skilled in the art, and it is intended to cover in the appended claims all such variations and modifications as fall within the true spirit and scope of the invention.

TABLE I

HEAT LOSS CONTROL DATA WITH A NICKEL OXIDE CATALYST

| Test Point | TA (%) | $T_{AD}$ (K) | Preheat (K) | $\dot{Q}$ (SCMH) | $O_2$ (%) | $CO_2$ (%) | CO (%/ppm) | UHC (ppm) | NO (ppm) | Comments |
|---|---|---|---|---|---|---|---|---|---|---|
| 1 | 87 | 1573 | 596 | 0.83 | 1.30 | 3.50 | 0.62/— | 3900 | 56.0 | 1 inch diameter reactor |
| 2 | 72 | ↓ | 599 | ↓ | 0.30 | 4.00 | 1.54/— | 6100 | 1.8 | |
| 3 | 63 | ↓ | 593 | ↓ | 0.20 | 4.10 | 3.60/— | 11000 | 4.2 | |
| 4 | 57 | ↓ | 598 | ↓ | 0.14 | 4.45 | 5.57/— | 17000 | 3.4 | |
| 5 | 121 | ↓ | 614 | ↓ | 2.30 | 5.30 | —/153 | 44 | 270.0 | |
| 6 | 90 | ↓ | 623 | 1.65 | 0.50 | 3.60 | 2.59/— | 920 | 0.3 | 1 inch diameter reactor |
| 7 | 80 | ↓ | 593 | ↓ | 0.50 | 3.40 | 5.25/— | 2900 | 0.35 | |
| 8 | 74 | ↓ | 607 | ↓ | 0.45 | 3.60 | 7.80/— | 5500 | 0.70 | |
| 9 | 93 | ↓ | 611 | ↓ | 2.75 | 2.70 | 0.43/— | 5400 | 48.0 | |
| 10 | 90 | 1700 | 644 | ↓ | 0.6 | 4.6 | 2.33/— | 1450 | 1.5 | 1 inch diameter reactor |
| 11 | 80 | ↓ | 634 | ↓ | 0.5 | 4.0 | 5.93/— | 3100 | 1.4 | |
| 12 | 74 | ↓ | 624 | ↓ | 0.6 | 4.5 | 9.30/— | 6700 | 2.0 | |
| 13 | 99 | ↓ | 698 | ↓ | 3.9 | 3.9 | 0.27/— | 6400 | 82.0 | |
| 14 | 122 | 1573 | 602 | 7.43 | 2.6 | 5.8 | 0 | 4 | 340.0 | 3 inch diameter reactor |
| 15 | 97 | ↓ | 650 | ↓ | 0.03 | 4.6 | 0.59/— | 150 | 5.0 | |
| 16 | 92 | ↓ | 616 | ↓ | 0.01 | 4.4 | 1.60/— | 400 | 2.4 | |
| 17 | 85 | ↓ | 626 | ↓ | 0.10 | 3.8 | 3.90/— | 420 | 2.4 | |
| 18 | 79 | ↓ | 647 | ↓ | 0.10 | 3.2 | 9.90/— | 1400 | 3.6 | |

| Test Point | $T_{guard}$ (K) | $O_2$ (%) | $CO_2$ (%) | CO (%) | UHC (ppm) | NO (ppm) | $NH_3$ (ppm) | HCN (ppm) | Total $NO_x$ (ppm) | Comment |
|---|---|---|---|---|---|---|---|---|---|---|
| 1 | 1253 | 0.5 | 3.6 | 2.59 | 920 | 0.3 | 7.2 | 9.5 | 17.0 | Variable guard heater temperature |
| 2 | 1024 | 2.30 | 3.2 | 0.83 | 12350 | 25.0 | 5.8 | 0 | 32.2 | |
| 3 | 954 | 2.90 | 3.0 | 0.51 | 15500 | 54.0 | — | — | — | |
| 4 | 930 | 3.20 | 3.0 | 0.89 | 14200 | 58.0 | 12.70 | 0 | 70.7 | |
| 5 | 1091 | 2.15 | 3.3 | 1.10 | 10750 | 20.0 | 20.80 | 4.6 | 25.4 | |

TABLE II

FUEL NITROGEN ($NH_3$) CONVERSION WITH HEAT LOSS CONTROL

| Test Point | TA (%) | Max. $NO_x$ (ppm) | $NO_x$* (ppm) | $NH_3$ (ppm) | HCN (ppm) | % Conversion $NO_x$* | % Conversion $NH_3$ | % Conversion HCN | % Conversion Total | Comments |
|---|---|---|---|---|---|---|---|---|---|---|
| 1 | 87 | 328 | 58.0 | 0.7 | 8.1 | 17.68 | 0.21 | 2.47 | 20.36 | One inch diameter reactor |
| 2 | 72 | 457 | 2.4 | 4.8 | 17.7 | 0.53 | 1.05 | 3.87 | 5.45 | |
| 3 | 63 | 680 | 4.4 | 13.2 | 15.0 | 0.64 | 1.94 | 2.00 | 4.58 | |
| 4 | 57 | 937 | 3.4 | 59.5 | 17.7 | 0.36 | 6.35 | 1.89 | 8.60 | |
| 5 | 121 | 329 | 280.0 | — | — | 85.21 | — | — | 85.21 | |
| 6 | 90 | 357 | 0.3 | 7.2 | 9.5 | 0.08 | 2.02 | 2.66 | 4.76 | One inch diameter reactor |
| 7 | 80 | 569 | 0.35 | 18.0 | 12.9 | 0.06 | 3.16 | 2.27 | 5.49 | |
| 8 | 74 | 807 | 0.70 | 90.8 | 22.1 | 0.09 | 11.25 | 2.74 | 14.08 | |
| 9 | 93 | 236 | 48.0 | 7.9 | 0.5 | 20.34 | 3.35 | 0.21 | 23.90 | |
| 10 | 90 | 456 | 1.5 | 25.6 | 18.0 | 0.33 | 5.61 | 3.94 | 9.88 | One inch diameter reactor |
| 11 | 80 | 673 | 1.4 | 50.3 | 19.8 | 0.21 | 7.47 | 2.94 | 10.62 | |
| 12 | 74 | 980 | 2.0 | 79.6 | 26.5 | 0.21 | 8.12 | 2.70 | 11.03 | |
| 13 | 99 | 378 | 82.0 | 4.4 | 0.9 | 21.72 | 1.17 | 0.24 | 23.12 | |
| 14 | 122 | 360 | 358.0 | — | — | 99.42 | — | — | 99.42 | 3 inch diameter reactor |
| 15 | 97 | 226 | 5.0 | 0.87 | 1.35 | 2.21 | 0.27 | 0.42 | 2.90 | |
| 16 | 92 | 381 | 2.4 | 3.71 | 6.89 | 0.63 | 0.98 | 1.81 | 3.42 | |

TABLE II-continued

| FUEL NITROGEN ($NH_3$) CONVERSION WITH HEAT LOSS CONTROL | | | | | | | | | | |
|---|---|---|---|---|---|---|---|---|---|---|
| Test Point | TA (%) | Max. $NO_x$ (ppm) | $NO_x$* (ppm) | $NH_3$ (ppm) | HCN (ppm) | % Conversion $NO_x$* | $NH_3$ | HCN | Total | Comments |
| 17 | 85 | 492 | 2.4 | 5.06 | 4.33 | 0.44 | 1.02 | 0.88 | 2.34 | |
| 18 | 79 | 1367 | 3.6 | 0 | 26.38 | 0.26 | 0 | 1.93 | 2.19 | |

What is claimed is:

1. A process for combusting a nitrogen-containing fuel with resulting low $NO_x$ emissions comprising the steps of directing a fuel-rich mixture of the fuel and primary air through at least one fuel-rich combustion zone having a catalytic bed the outer perimeter margin of which is carried by a support structure which comprises a wall, catalytically combusting the mixture within the bed to release thermal energy, limiting transfer of thermal energy from the bed into the support structure to maintain the outer perimeter margin of the bed at an optimum temperature which minimizes formation of $NO_x$ during the combustion, the step of limiting transfer of the thermal energy including heating the portion of the wall which is disposed about the first bed to a temperature of greater than 1000° K. during the entire combustion process to minimize the temperature differential between the wall and outer perimeter of the bed and thereby minimize the rate of the heat transfer therebetween, exhausting products of combustion from the bed with such products of combustion being mixed with secondary air and directed through at least one downstream bed comprised of a catalyst material, and catalytically combusting the mixture in the downstream bed to substantially complete combustion of the fuel.

2. A process as in claim 1 in which the flow rate of primary and secondary air is in an overally stoichiometric proportion with the flow rate of fuel, including the step of extracting thermal energy from the products of combustion exhausting from the first bed for limiting temperature of combustion in the downstream bed to below the use temperature of the catalyst material of the downstream bed.

3. A process as in claim 1 in which the step of heating the wall is carried out by directing electrical current through resistance elements disposed about the wall.

4. A process as in claim 1 in which the step of heating the wall is carried out by cyclically passing an electromagnetic inductance heating field through the wall about the bed.

5. A process as in claim 1 in which the step of heating the wall includes directing at least a portion of the products of combustion from the first bed along a path in heat-exchange relationship with the portion of the wall which is disposed about the first bed.

6. A process as in claim 1 in which the step of heating the wall is carried out by combusting a fuel to produce a flame and directing the flame in heat-exchange relationship with the portion of the wall which is disposed about the first bed.

7. A process as in claim 1 in which the combustion products from the first bed comprises a fuel-rich mixture and are directed into an additional catalytic bed carried by a support structure and disposed between the first and second mentioned catalytic beds, catalytically combusting the mixture within the additional bed to release thermal energy, limiting transfer of thermal energy from the additional bed into the support structure by heating the portion of the wall which is disposed about the additional bed to a temperature of greater than about 1000° K. during the entire combustion process to minimize the temperature differential between the wall and outer perimeter of the bed and thereby minimize the rate of heat transfer therebetween.

* * * * *